United States Patent [19]

Goettl

[11] Patent Number: 4,939,797

[45] Date of Patent: Jul. 10, 1990

[54] WATER DELIVERY ASSEMBLY FOR CLEANING SWIMMING POOLS

[75] Inventor: John M. Goettl, Phoenix, Ariz.

[73] Assignee: Sally Ghiz, Phoenix, Ariz.

[21] Appl. No.: 330,195

[22] Filed: Mar. 29, 1989

[51] Int. Cl.[5] ..... E04H 3/20; B05B 3/00; B05B 15/10

[52] U.S. Cl. ..... 4/490; 4/492; 4/496; 239/204; 239/206; 134/167 R

[58] Field of Search ..... 239/204, 206, 205, 66; 134/167 R, 166 R, 168 R; 4/490, 496, 492

[56] References Cited

U.S. PATENT DOCUMENTS

| | | | |
|---|---|---|---|
| 1,144,619 | 6/1915 | Snyder | 239/204 |
| 1,628,041 | 5/1927 | Frye | 239/204 |
| 1,964,269 | 6/1934 | Munz | 299/18 |
| 2,278,976 | 4/1942 | Crume | 299/61 |
| 2,756,099 | 7/1956 | Reynolds, Jr. | 299/61 |
| 2,812,977 | 11/1957 | Phillips | 239/204 |
| 2,989,246 | 6/1961 | Sloane | 239/204 |
| 3,045,829 | 7/1962 | Rule et al. | 210/169 |
| 3,107,056 | 10/1963 | Hunter | 239/206 |
| 3,127,110 | 3/1964 | Reynolds | 239/204 |
| 3,149,784 | 9/1964 | Skidgel | 239/206 |
| 3,237,866 | 3/1966 | Louell | 239/204 |
| 3,247,968 | 4/1966 | Miller | 210/136 |
| 3,317,144 | 5/1967 | Muschett | 239/204 |
| 3,408,006 | 10/1968 | Stanwood | 239/66 |
| 3,449,772 | 6/1969 | Werner | 4/490 |
| 3,506,489 | 4/1970 | Baker | 134/10 |
| 3,521,304 | 7/1970 | Ghiz | 4/490 |
| 3,702,173 | 11/1972 | Reynolds | 239/204 |
| 3,747,129 | 7/1973 | Dyar | 4/661 |
| 3,770,203 | 11/1973 | Dyar | 239/205 |
| 3,785,565 | 1/1974 | Perry et al. | 239/206 |
| 3,792,095 | 12/1988 | Pristo et al. | 239/204 |
| 3,854,664 | 12/1974 | Hunter | 239/206 |
| 3,955,764 | 5/1976 | Phaup | 239/206 |
| 4,114,206 | 9/1978 | Franc | 4/490 |
| 4,188,673 | 2/1980 | Carter | 4/490 X |
| 4,195,371 | 4/1980 | Goodin | 4/490 |
| 4,200,230 | 4/1980 | Gould | 239/66 |
| 4,212,088 | 7/1980 | Goettl et al. | 4/490 |
| 4,271,541 | 6/1981 | Mathews | 134/168 R X |
| 4,322,860 | 4/1982 | Gould | 239/204 X |
| 4,371,994 | 2/1983 | Mathews | 134/167 R X |
| 4,391,005 | 7/1983 | Goettl | 134/167 R X |
| 4,535,937 | 8/1985 | Fagan et al. | 239/204 X |
| 4,687,139 | 8/1987 | Lockwood | 239/205 |
| 4,783,004 | 11/1988 | Lockwood | 239/206 X |

*Primary Examiner*—Henry K. Artis

*Attorney, Agent, or Firm*—Charles E. Cates; Frank T. Barber

[57] ABSTRACT

This disclosure relates to apparatus for cleaning swimming pools, incorporating intermittent pop-up jet nozzles, the nozzles being adapted to intermittently rotate and project cleaning jets of water adjacent the inner surface of the pools. Wear and tear on the nozzle housing and related parts is minimized by use of a water delivery assembly in which the stop means for arresting upward movement of the nozzle are located in the lower part of the housing, thus eliminating bending moment of stress force against the housing and related parts. The inclusion of a retainer or cage within the housing provides other improvements in the operation of the water delivery assembly.

13 Claims, 5 Drawing Sheets

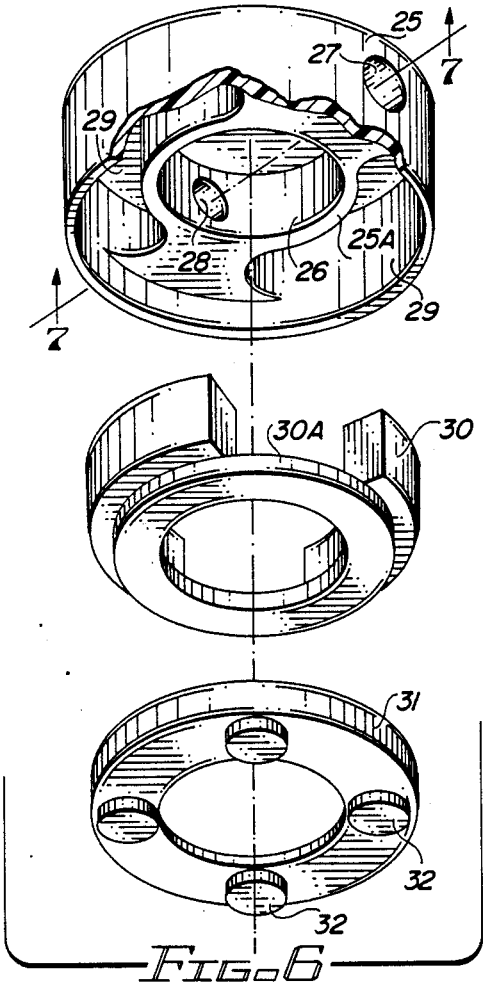
FIG. 6
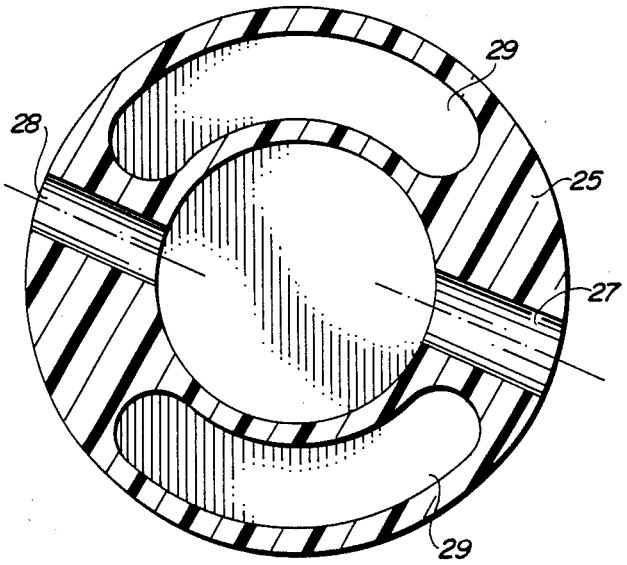
FIG. 7
FIG. 8
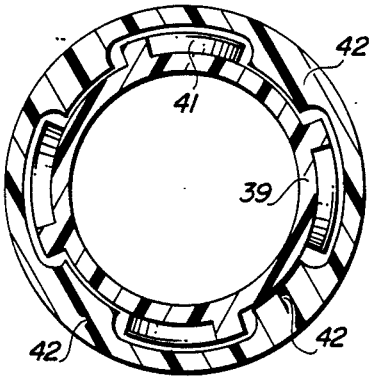
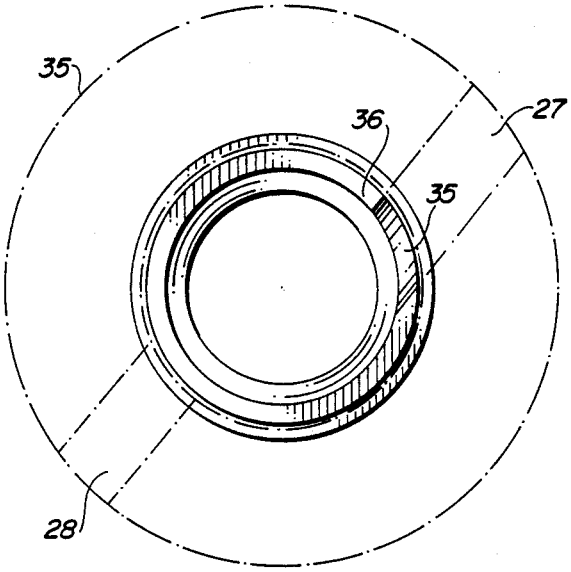
FIG. 10
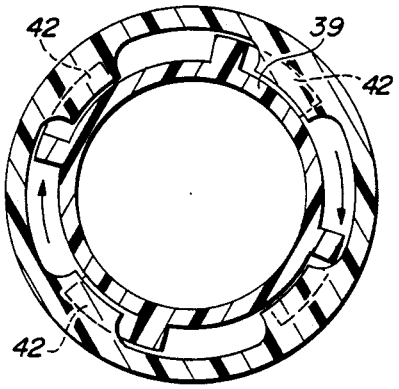
FIG. 9

WATER DELIVERY ASSEMBLY FOR CLEANING SWIMMING POOLS

FIELD OF THE INVENTION

This invention relates to the cleaning of swimming pools and more particularly to water delivery assemblies for directing high pressure streams of water along the inner surfaces of the pool bottom and walls to cause a scrubbing action and loosen dirt and sediment adhering thereto.

BACKGROUND AND PRIOR ART

Various jet means have been used successfully to clean the inner surfaces of swimming pools. Some of these jet reaction devices have included jet tubes of flexible nature which have been capable of sinusoidal action in response to jet efflux from the ends of the tubes. More recent jet means have comprised nozzles embedded in the floor or walls of the pool, adapted to pop up at intervals to project a pressurized stream of water in parallel and scrubbing relation to the inner surface of the pool.

A problem which is associated with pop-up nozzles is that the constant jarring which results when the nozzles are repeatedly sequenced from inoperative to extended position causes a strain not only on the nozzle itself but on the housing and associated parts of the nozzle assembly. The problem may be illustrated by reference to FIG. 1 of the attached drawings, which is a simple schematic sketch of a typical pop-up nozzle currently in use in the swimming pool industry. In FIG. 1, a housing 10 is installed in the bottom of a swimming pool with its top being flush with the pool surface The bottom of housing 10 is secured to and in communication with a water inlet pipe 11. When the water is turned on, the flow of water into the housing at 13 causes the hollow nozzle 12 to pop up to its extended position, allowing a pressurized stream of water from aperture 14 to scrub the adjacent surface of the pool. Each time the water pressure is turned on, the nozzle ring member 15 hammers against the housing shoulder member 16. Since an individual nozzle may be sequenced on and off as many as 25 or 30 times in a daily treatment pattern, and since the hammering occurs at a point removed from where the housing is secured to the inlet pipe, there is a continuing threat to the integrity of the installation, caused by bending moment stresses and strains on the plastic parts between the two points.

Arrangements similar to that described above in connection with FIG. 1 have been disclosed in Goettl, U.S. Pat. No. 4,212,088; in Carter, U.S. Pat. No. 4,188,673; and in Fagan, U.S. Pat. No. 4,535,937. Damage to the housing or its components is of significant consequence, since the repair necessarily involves removing and reinstalling a permanent structure.

A further problem in the prior art arrangements is that the sequencing valves normally used in controlling the flow of water in systems of this nature are not designed to achieve a 100% shut-off when in the closed position. This results in some leakage of water pressure to the in-floor water delivery heads, even though they may be in the off cycle. This leakage water pressure, although not strong enough to cause the nozzle to pop up, nevertheless causes a slow turning of the nozzle in its retracted position and gives the appearance of a non-efficient system.

Previous systems also present a problem when it is desired to remove water delivery head assemblies while the pool is filled with water. Although long-handled tools have been designed to engage the water delivery heads, and then turn and remove them while standing on the pool-side deck, excess force and skill is required to operate such tools, to engage the matching lugs and recesses and to keep them engaged as the nozzle is being removed.

It is an object of the present invention to provide a water delivery assembly which overcomes the above-mentioned disadvantages of previous systems.

It is a further object of the invention to provide an assembly which is protected and dampered against the constant, abrupt, battering effect of the pop-up head against the stop elements of the housing.

It is another object to provide an assembly in which damage, if at all, is caused with respect to easily replaceable parts, rather than components of the permanent installation.

It is still another object to provide means for diverting leakage water pressure in the off cycle, to avoid unwanted turning of the nozzle while in its retracted position.

It is yet another object to provide a remote removal tool which cooperates with the water delivery assembly in such manner that the unlocking and removal of the nozzle assembly is accomplished with a maximum of ease and efficiency.

Other objects and advantages will become apparent as the specification proceeds.

SUMMARY OF THE INVENTION

This invention is based on the discovery that the durability and resistance to failure of water delivery assemblies can be significantly increased by locating the point of pop-up impact at a substantial distance below the surface of the pool. That is, if the shoulders or other stop means for limiting upward movement of the nozzle are located in the lower part of the housing, at a point adjacent the point where the housing is attached to the inlet pipe, rather than closely adjacent the surface of the pool, the abrupt hammering effect which occurs when the pop-up motion loads against the stop means is significantly attenuated.

In one embodiment of this invention, it has been found that this relocation of the stop means can be achieved by providing the nozzle with an elongated stem portion, with stop means located adjacent its lowermost edge, for engagement with related stop means located in the housing, adjacent its lower portion, where the housing joins the inlet pipe.

This invention therefore may be described in general terms as a water delivery assembly for cleaning the inner surfaces of a swimming pool, said assembly comprising inlet pipe means for introducing water under pressure into said pool; a housing in fluid communication with said inlet pipe means, said housing having an outer open end communicating with the interior of said swimming pool and an inner open end fixedly attached to said inlet pipe; a water delivery head retainer or cage removeably locked to the interior of said housing; a water delivery head comprising a nozzle and a stem portion attached thereto, said nozzle having at least one water aperture therein to project a pressurized stream of water in adjacent parallel and scrubbing relation to the inner surface of said pool, said delivery head being mounted in said housing and adapted for reciprocal motion therewithin to an extended operative position and a retracted inoperative position; said water delivery head responsive to the application of pressurized water to said housing for extending to said extended operative position; said head also responsive to the removal of pressure from the water in said housing for retraction to said retracted inoperative position; annular shoulder means located at the lower end of the stem portion of said delivery head; and stop means located on the interior of said housing, cooperating with said annular shoulder means to provide the upper limit of extension of said delivery head, said stop means being located in the bottom part of said housing and adjacent the point where the housing is attached to said inlet pipe, whereby the impact of shoulder against stop causes minimum bending stress on said housing.

As will be seen as the specification proceeds, the aforesaid cage or retainer provides a unit which cooperates with other members of the nozzle assembly to bleed off leakage water pressure in the off cycle and to provide an efficient and positive means for unlocking and removing nozzle assemblies from a remote point.

BRIEF DESCRIPTION OF THE DRAWINGS

The objects, features and advantages of the invention will be apparent to those skilled in the art from the following detailed description, taken together with the accompanying drawings, in which:

FIG. 6 is an exploded perspective view of the nozzle itself, showing the nozzle shell, the metal weights which fit in cavities in the shell, and the bottom retainer ring.

FIG. 7 is an enlarged fragmentary sectional view taken along line 7—7 of FIG. 6 showing the cavities in the nozzle shell, as well as the two different sizes of water jet apertures.

FIG. 8 is a top sectional view taken along line 8—8 of FIG. 4, showing the unlocked position of the bayonet locking device for securing the retainer to the housing.

FIG. 9 is a view similar to FIG. 8 but showing the bayonet locking device in locked position.

FIG. 10 is a top view, taken along line 10—10 of FIG. 3, showing the top of the nozzle stem secured to the nozzle shell, in registry with one of the water jet apertures.

DETAILED DESCRIPTION OF THE INVENTION

The water delivery assembly of the present invention is designed to be embedded in the bottom surfaces of swimming pools, for the purpose of delivering a pressurized stream of cleaning and scrubbing water to said surfaces in the area of the delivery assembly. In the practice of the invention, multiple assemblies are embedded in the pool surface, in spaced apart relationship to provide the optimum coverage. Not all the embedded assemblies are designed to be operative at the same time, but rather they are energized in a sequential off and on pattern.

Water supply systems, including pumps, filters and sequencing valves, are well-known in the art for providing water under pressure to multiple cleaning heads or assemblies located in the pool bottom or walls. One such system is shown in Goettl U.S. Pat. No. 4,212,088. In operation of the Goettl system, a pump withdraws water from the pool and delivers it to a filter, which in turn delivers the water under pressure to a sequencing valve which communicates through individual pipes with each of the cleaning heads or assemblies embedded in the pool. The sequencing valve sequentially energizes each of the individual heads in a predetermined pattern.

Figure 2:
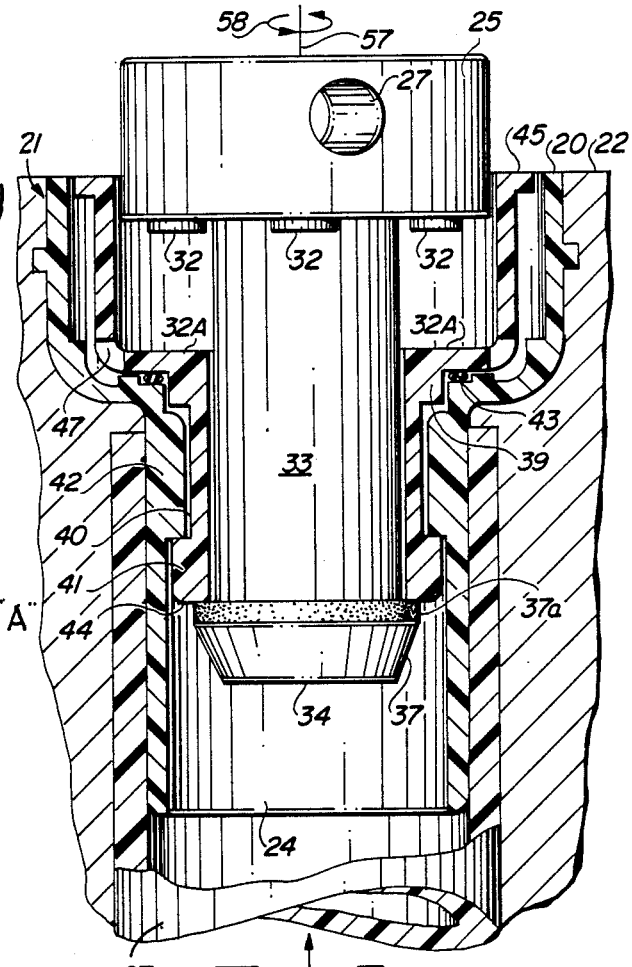
FIG. 2 is a sectional view of the water delivery head of the present invention, showing the nozzle maintained in its extended, operative position by the flow of water from the water inlet pipe.
Figure 4:
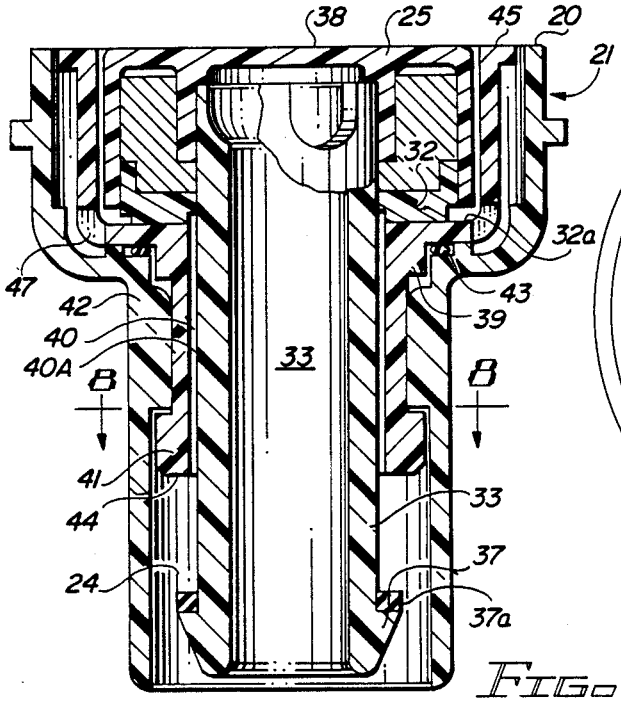
FIG. 4 is a sectional view similar to FIG. 2, except showing the nozzle at rest in its lowermost, inoperative position, with the top of the nozzle flush with the surface of the pool.
Figure 5:
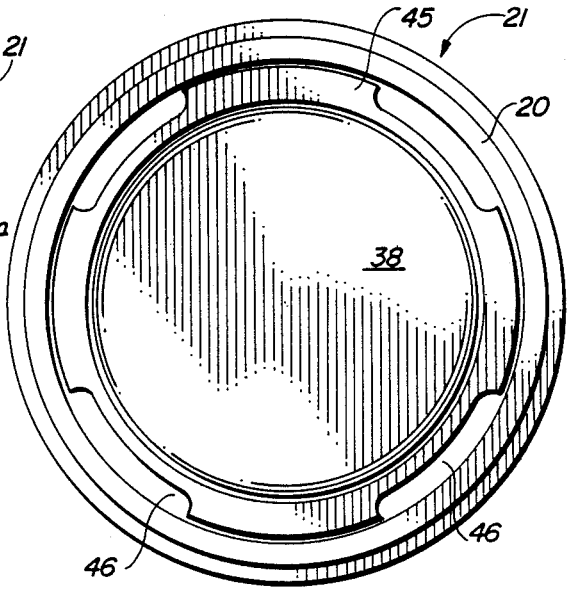
FIG. 5 is a top view of the water delivery assembly, showing the openings in the upper flange of the retainer.
Figure 3:
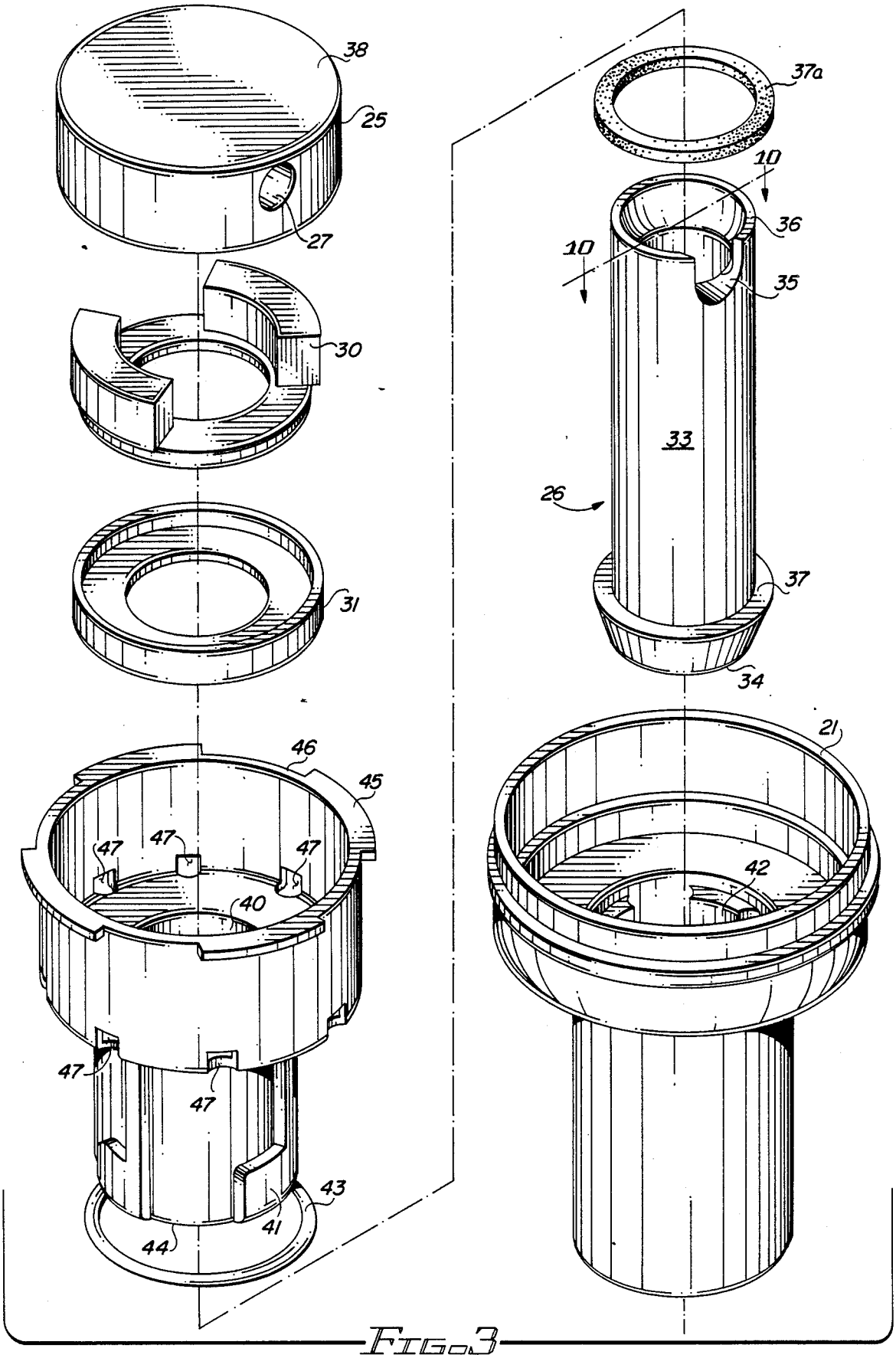
FIG. 3 is an exploded perspective view of the entire water delivery head, showing the manner of assembly of the various components.

Referring to FIGS. 2, 3 and 4, the water delivery assembly of the present invention is provided with a housing 21 having an upper open end 20 which is substantially flush with the bottom pool surface 22. Connecting with the housing 21 at its other end is an inlet pipe 23 which is one of the conduits from the sequencing valve, as heretofore described. When the sequencing valve which controls the flow of water through pipe 23 is activated, water is supplied under pressure to housing 21, in the direction of the arrow shown in FIG. 2. The joint between the housing 21 and the inlet pipe 23, generally shown in the area marked "A" in FIG. 2, can be solvent welded, although other means such as threading can be employed.

The housing 21 is provided with an internal bore 24 in which a pop-up jet reaction rotated nozzle assembly is rotatably and reciprocally mounted. The nozzle assembly is comprised of an upper body shell 25 and a lower stem portion 33. As best shown in FIGS. 6 and 7, the upper body of the nozzle assembly is a shell 25 having a central vertical bore 26 which is in communication with two additional bores 27 and 28 lying in a generally horizontal plane and extending through the outside wall of the upper body. As shown in FIG. 7, these horizontal bores are eccentric with respect to the vertical axis of rotation of the nozzle body and are responsible for directing the flow of cleansing and scrubbing water from the nozzle along the surface of the pool. As will be seen, one of the horizontal bores is smaller than the other, and at the time when the parts for a particular order are being assembled at the factory, the person assembling the water delivery heads has the option of blocking off one of the bores and using the other, depending on whether a smaller or larger flow of scrubbing water is required at the point in the pool where the particular nozzle is to be installed.

As shown in FIGS. 6 and 7, the upper body shell is also provided with cavities 29 which match the configuration of a weight 30, which may be made of a heavy metal such as brass. In assembling the upper body of the nozzle, the weight 30 is inserted into the matching chambers 29 of the shell 25, and then bottom cap 31 is snapped into place and solvent welded to hold the body assembly together. The bottom surface of cap 31 is provided with spacer lugs 32, whose function will be hereinafter described. It will be noted that the ring 30A of the metal weight 30 bears directly against the internal ledge 25A of the shell 25, closely adjacent the point where the bore 26 of the shell 25 is joined to the nozzle stem 33. Thus, the upward inertia of the metal weight is transferred strictly in a sheer relationship between the stem 33 and nozzle shell 25, virtually eliminating unwanted bending stress from such loading.

The other part of the nozzle assembly is an elongated hollow stem 33 having an open bottom end 34 and an opening 35 in its side wall adjacent its upper end 36. When the upper body shell 25 and the hollow stem 33 are assembled to provide the nozzle, the hollow stem is inserted upwardly into the central bore 26 of the shell, in such manner that the opening 35 registers with either the smaller or the larger of the eccentric bore holes 27 or 28, and then secured in place by solvent welding or other means, thus giving the option of providing a larger or smaller flow of water at the particular place where the nozzle is to be installed in the pool.

The hollow stem portion 33 of the nozzle assembly has an annular shoulder 37 located adjacent its bottom end, said shoulder acting in cooperation with stop means, to be described, on the interior of the housing, for limiting the upward movement of the nozzle assembly. The shoulder 37 may be protected and cushioned by an O-ring **37*a* encircling the stem 33**.

The nozzle assembly is responsive to the application of pressurized water to the housing 21 through the inlet pipe 23, for extending the nozzle to an extended operative position, as shown in FIG. 2. The nozzle assembly is also responsive to the removal of pressure from the water in housing 21 for retraction to the retracted inoperative position, as shown in FIG. 4. The upper body portion of the nozzle assembly is provided with a flat upper end 38 which, when at rest as shown in FIG. 4, is substantially flush with the bottom surface 22 of the pool. Thus, when the cleaning system is not operating, all apparatus is flush with the inner pool surfaces to thereby alleviate safety hazards otherwise present in the form of obstructions on the pool bottom.

The use of a nozzle assembly having an elongated stem provides room within the housing 21 for inclusion of a retainer or cage member 39, which functions in a number of ways to improve the operation of the water delivery system. Thus, as will be seen, retainer 39 provides the stop members for limiting the upward and downward movement of the nozzle assembly. Further, it cooperates with the lugs 32 to bleed off water pressure from leaking valves and thus eliminates unwanted spinning of the nozzle when the nozzle is supposed to be at rest. Also, it provides a connection with a removal tool (described hereinafter) for remote unlocking of the nozzle assembly, for nozzle removal when the pool is filled with water.

The retainer 39 is shown in perspective view in FIG. 3 and is shown in its installed state in FIGS. 2 and 4. It is designed to fit inside the housing 21, and its outside configuration conforms generally to the inside configuration of the housing. Retainer 39 is also designed to accept the nozzle assembly, and therefore its inside configuration generally conforms to the outside configuration of the assembled nozzle parts. Specifically, the lower portion of retainer 39 is provided with an internal bore 40 slightly larger than the outside diameter of the stem portion 33 of the nozzle assembly, so that the stem portion 33 can be inserted inside retainer 39 and is freely rotatable therein. The upper portion of retainer 39 is of enlarged diameter to accept the wider upper body portion of the nozzle assembly.

The retainer 39 is adapted for locking into the housing 21 by use of a bayonet-type locking device and therefore is provided at its lower end with bayonet locking lugs 41 which cooperate with matching bayonet locking lugs 42 on the interior surface of the housing 21. When retainer 39 is inserted into housing 21 and then twisted clockwise, as shown in FIGS. 8 and 9, the locking lugs 41 and 42 are engaged, and work together to lock the retainer in place. Resiliency for maintaining the locked position is provided by the O-ring 43 which cushions the seating of the retainer 39 in the housing 21.

When the retainer is locked into position, as above, its lower edge 44 (including the bayonet lugs 41) provides the stop against which the shoulder 37 of the nozzle stem impinges to provide the upper limit of extension of the said delivery head assembly. See FIGS. 2 and 4.

The retainer 39 is provided with an upper lip 45 which is interrupted at intervals by openings 46, as best shown in FIG. 3. The openings are useful for engagement by a locking tool (hereinafter described) for twisting the retainer into a locked or unlocked position. They are also useful for providing escape of valve leakage water pressure from the inside of the housing into the pool. The retainer 39 is also provided with openings 47 in its side wall for the same purpose, as hereinafter described.

Figure 13A:
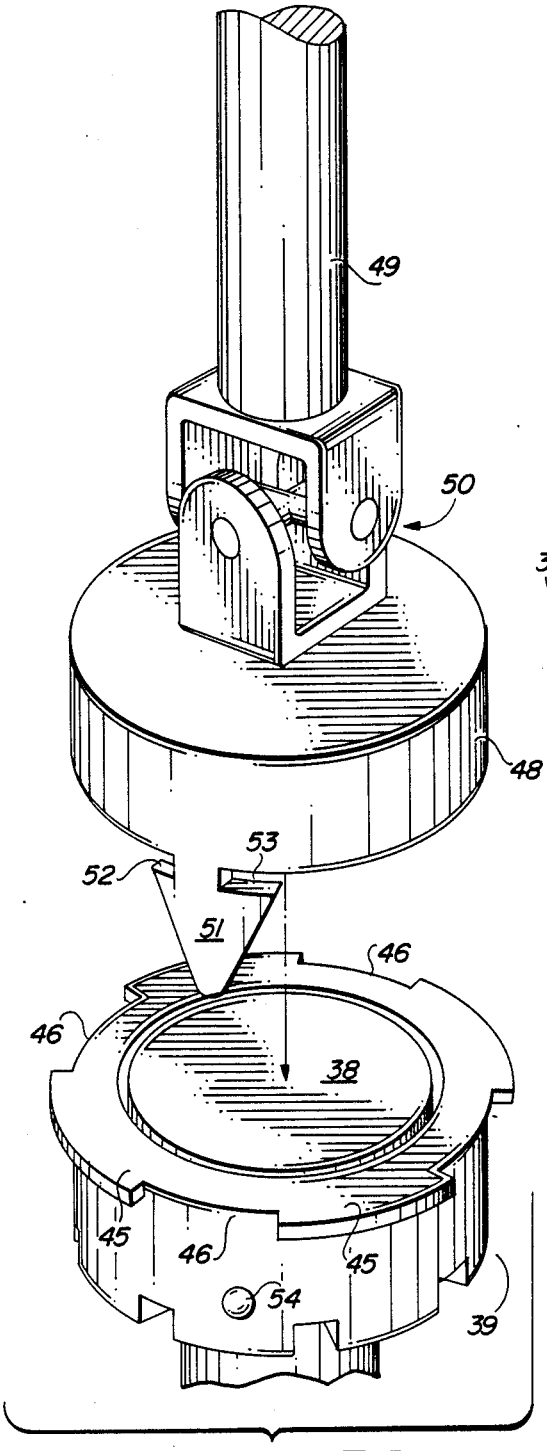
FIG. 13A is a perspective view of a locking/unlocking tool, showing hooks for engagement of recesses in the retainer flange.

The retainer 39 is also adapted to cooperate with a locking/unlocking tool in a unique manner to provide positive and effective contact between retainer and tool during the locking or unlocking operation. As best shown in FIG. 13A, the tool comprises a body 48 which is fitted to a handle 49 by means of a universal joint 50. The handle may be short, for use when the pool is empty and the installer has close access to the point where the water delivery assembly is to be locked into the housing, or the handle may be a long pole, for removing or inserting the assembly when the pool is filled with water. The tool body 48 is approximately the same size as the outer circumference of the retainer body 39 and is fitted with multiple hooks 51 adapted to be inserted downwardly into the openings 46 and be twisted into engagement with the underside of the flange 45 of the retainer 39.

Figure 13B:
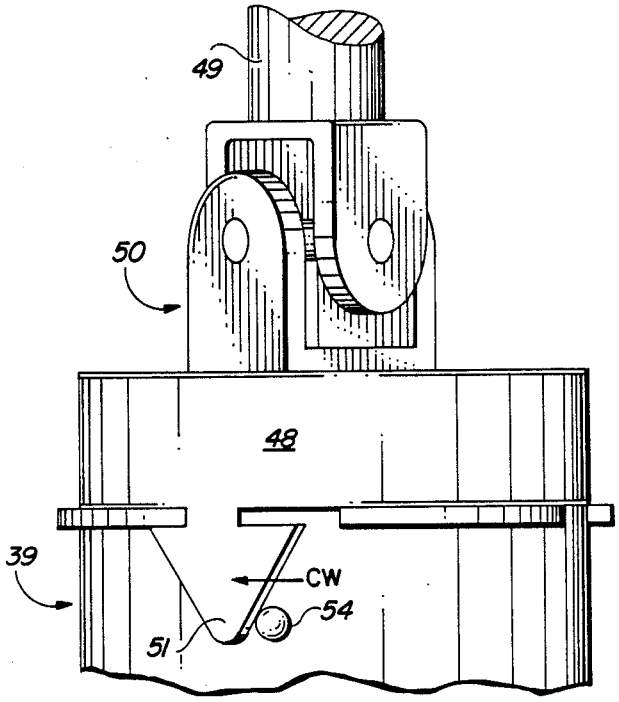
FIG. 13B is a side view of the said locking/unlocking tool engaged with the retainer flange, in position for locking the retainer to the housing.
Figure 13C:
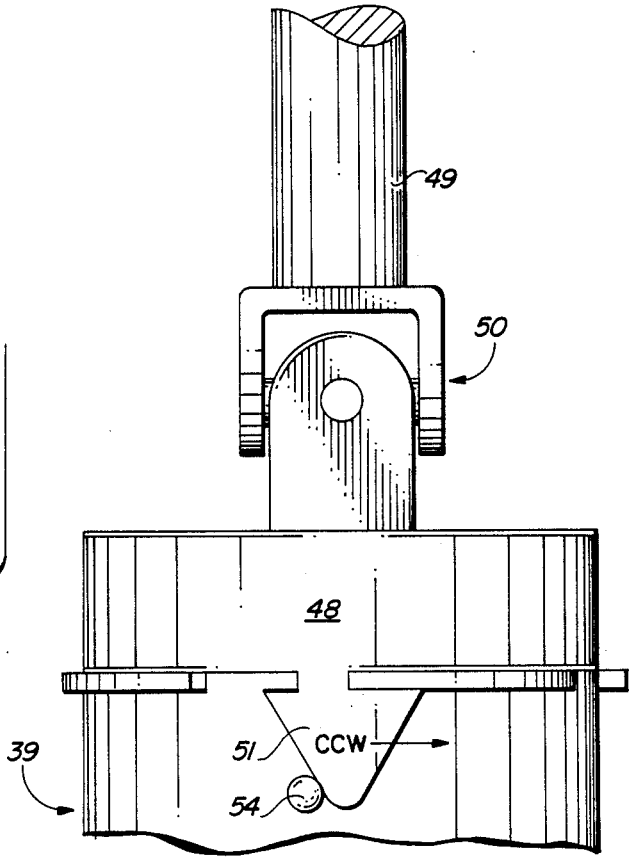
FIG. 13C is a side view of the said tool engaged with the retainer flange in a position for unlocking the retainer from the housing.

When the tool 48 is being used to lock a retainer/nozzle assembly into place, it is inserted and twisted clockwise to the position shown in FIG. 13B, so that the retainer flange engages the slot 52 above the hook 51, and in this position a further clockwise turn will cause the bayonet type lock between retainer 39 and housing 21 to be locked. A short counterclockwise twist will then disengage the tool. When the tool 48 is being used to unlock a retainer/nozzle assembly, it is inserted and twisted counterclockwise to the position shown in FIG. 13C, so that the retainer flange 45 engages the slot 53 above the hook 51, and in this position a further counterclockwise twist will open the bayonet type lock between retainer 39 and housing 21, so that the retainer/-nozzle assembly can be removed from the housing. To assist in holding the tool engaged to the retainer after unlocking, the retainer body 39 is provided with a raised friction nub 54, which retains the hook in its engaged position until the unlocked retainer/nozzle assembly is lifted out of the housing and out of the pool. This is especially useful when the pool is filled with water and the retainer/nozzle assembly is being removed from a remote location, with a long pole.

Figure 11:
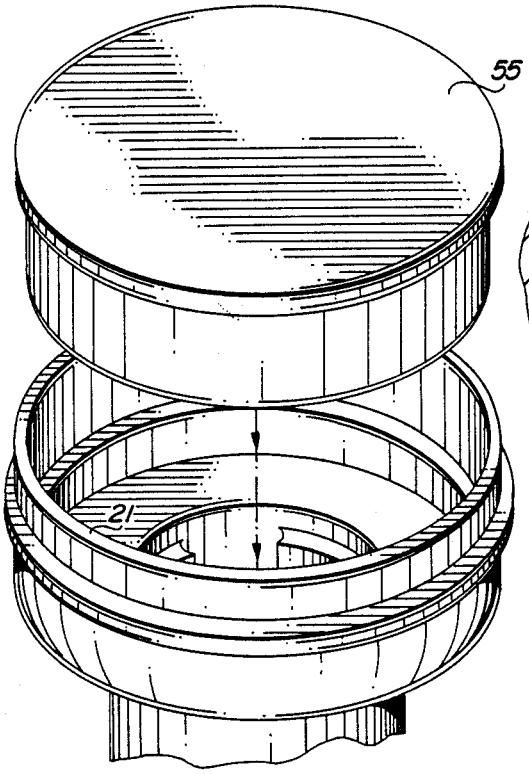
FIG. 11 is a perspective view of the water delivery housing, with nozzle and retainer removed, ready to receive the plastering cap for use in the subsequent plastering step.
Figure 12A:
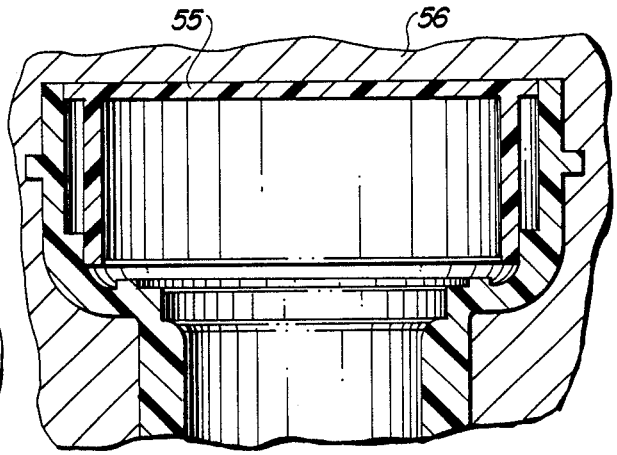
FIG. 12A is a cross sectional side view of the housing, with the plastering cap in position.
Figure 12B:
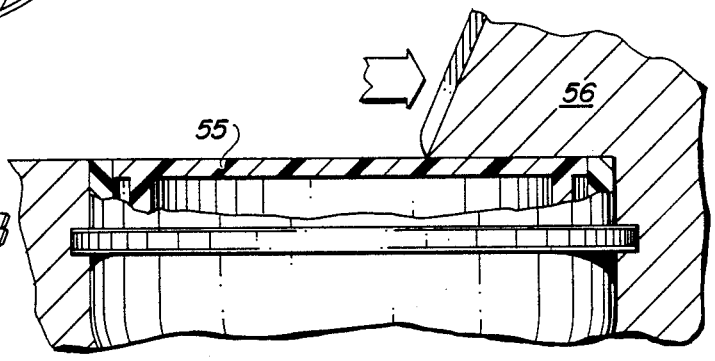
FIG. 12B is substantially the same as FIG. 12A, but showing the plastering procedure in operation.
Figure 12C:
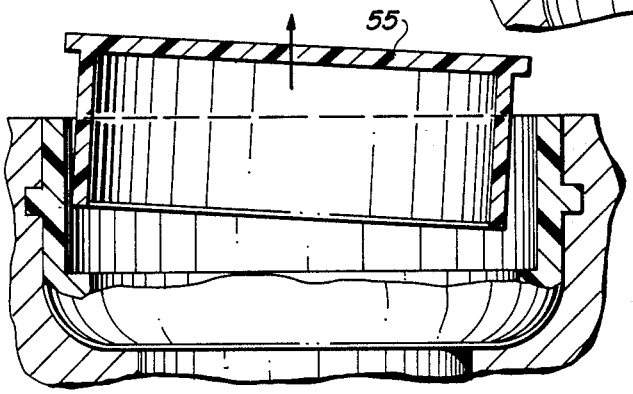
FIG. 12C is a cross sectional side view of the housing, showing the plastering cap being ejected from the housing by use of water pressure, after the plastering is completed.
Figure 12D:
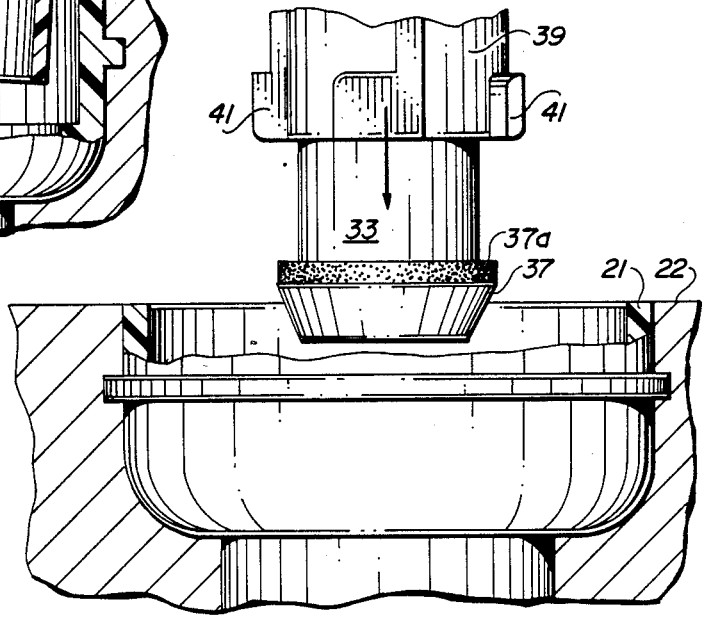
FIG. 12D is a side view of the housing, with plastering cap removed and the nozzle and retainer assembly being inserted for completion of the installation.

The present invention also incorporates the use of a plaster cap for providing an elegantly finished joint between the installed housing 21 and the plastered surface of the pool. When the housing 21 has been attached to the inlet pipe 23 and is ready to be plastered into the pool surface, the plaster cap 55 is inserted in the top of the housing 21 in the manner shown in FIG. 11 (prior to insertion of the retainer and nozzle assembly). Plaster 56 is applied to the surrounding pool surface, including on top of the plaster cap, as shown in FIG. 12A, and then the top surface is troweled, as in FIG. 12B, leaving a joint between plaster and housing with no imperfections. Finally, when the plaster has set, the plaster cap 55 is removed by turning on the system water pressure to eject the cap, as shown in FIG. 12C. The housing is then ready for insertion of the retainer and nozzle assemblies, as in FIG. 12D.

Before inserting the retainer and nozzle, these parts will have been assembled into a single unit. This assembly step is normally carried out at the factory, when the parts order for a particular pool job is being filled. The sequence of steps for assembling the nozzle and retainer may be understood more readily by reference to FIG. 3, which is an exploded perspective view of the entire water delivery head, as well as FIG. 6, which is an exploded view of the nozzle assembly itself In carrying out the assembly, the O-ring 37*a* is slipped over the top open end 36 of the elongated nozzle stem 33, and then the open end 36 of the nozzle stem is inserted upwardly through the bottom end of the retainer 39 and through the bore 40 in said retainer, until the stop 37 at the lower end of the nozzle stem contacts the retainer's lower edge 44. Elements 25, 30 and 31 comprising the upper body of the nozzle are then assembled by inserting the heavy metal weight 30 in the cavities of the shell 25 and snapping the bottom cap 31 into place and solvent welding to hold the assembly together. Next, the open end 36 of the nozzle stem is inserted upwardly into the central vertical bore 26 of the upper nozzle body and then twisted until the opening 35 registers with either the larger 27 or the smaller 28 of the eccentric bore holes which are horizontally disposed in the said nozzle body. When proper registry has been attained, the stem is secured in place in the vertical bore by solvent welding. The nozzle body and nozzle stem have now been formed into a single moving part, which is freely movable up and down within the retainer 39, but which is retained thereby, as shown in FIGS. 2 and 4.

As the final step, at the pool site, the O-ring 43 is slipped over the bottom portion of the retainer 39, and the retainer, containing its captive nozzle assembly, is inserted down into the housing 21 and locked into place with a clockwise turn, as heretofore described. The pronged tool 48 inserted in the openings 46 of the lip 45 of the retainer 39 assists in performing the locking twist.

The operation of the water delivery assembly will now be described as follows: When no water pressure is being applied to a particular delivery assembly, the nozzle assembly will be at rest, with the lugs 32 resting on the shelf 32A of retainer 39, as best shown in FIG. 4. In this position, the top 38 of the nozzle body is flush with the surface of the pool. When water pressure is applied to a particular water delivery head, the water enters from inlet pipe 23 in the direction shown by the arrow in FIG. 2 and flows upwardly through the hollow stem portion 33 of the nozzle assembly and then outwardly through the jet reaction opening 27. As mentioned, the jet reaction outlet 27 is eccentric with respect to the vertical axis of rotation 57 of the nozzle assembly, and therefore the jet reaction causes rotation of the nozzle assembly as shown by the arrows 58 in FIG. 2. The action of the jet reaction outlet 27 therefore causes not only a rotation of the nozzle but also a flow of water in a stream substantially parallel to the bottom surface of the pool.

Further, it will be seen that the nozzle stem 33 is disposed in the bore 40 of retainer 39 in such manner that there is substantial clearance between the outer diameter of the nozzle stem and the inner surface of the retainer bore. Thus, when water pressure is applied, there is flow of water not only upwardly through the interior of the hollow nozzle stem but also upwardly inside the retainer 39 and around the outside of the nozzle stem. As the nozzle is energized by water pressure in the retainer, it moves upwardly until the jet reaction outlet 27 emerges above the surface 22 of the pool, at which time jet reaction causes rotation of the nozzle assembly while it is floating in the water bearing being provided by the water surrounding the nozzle stem 33 in the retainer 39. Thus water is flowing all around the nozzle as it moves upwardly, and it is thereby floated in a water bearing as jet reaction from the jet outlet 27 causes rotation of the nozzle.

As the nozzle continues its upward movement, the stop shoulder 37 located adjacent the bottom end of the nozzle stem engages the bottom 44 of the retainer 39, and at the same time friction of the stop shoulder 37 against the 44 causes the nozzle to stop rotating.

Thus, each time a nozzle is energized, it extends from its housing and rotates during such extension. When the nozzle shoulder abuts its stop, the nozzle's upward and rotary motion is stopped to thereby leave the nozzle stationary with a strong stream of water issuing therefrom. When the nozzle is deenergized, it returns to its flush position. Subsequent energizations result in similar movement of the nozzle. Since the nozzle stops in a randomly different angular position each time it is energized, the streams overlap to clean the entire area surrounding the nozzle.

It will be understood that as many as 10 or 15 of the water delivery nozzle assemblies, as just described, will be placed in the bottom of a particular pool. The sequencing arrangement for the supply or water is operated in such manner that not more than one or two nozzles are energized at a single time, thereby taking the full flow of pressure from the pump, which causes very powerful jet action to be projected along the bottom of the pool and up the sides thereof and to thereby cause very efficient removal of sediment from the bottom of the pool. The sediment and foreign matter is suspended in the water so that it may be returned to the pump through the conduits provided, and deposited in the filter before the water is again conducted through the sequencing valve for energizing the next water delivery head or heads.

Figure 1:
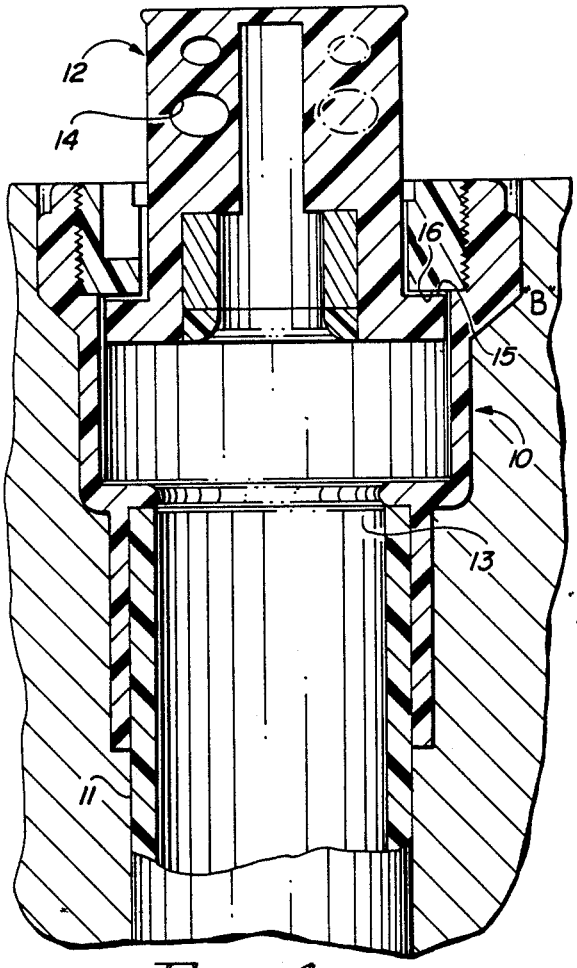
FIG. 1 (PRIOR ART)
FIG. 1 is a fragmentary sectional view of a water delivery head which is typical of the prior art, showing the nozzle moving upwardly into operative position.

The water delivery assembly of the present invention provides the following features which are significantly advantageous in terms of usefulness, economics and durability of structure:

1. In the present invention, the stop means limiting upward extension of the nozzle is located directly adjacent the point "A" where the housing 21 is secured to the inlet pipe 23, resulting in virtual elimination of bending moment stress forces against the housing and related components when the stop impact occurs. In the prior art arrangement shown in FIG. 1, the stop impact force occurs at point "B" which is a substantial distance from the fulcrum at point "A" where the housing is joined to the inlet pipe. This substantial distance between fulcrum and impact force point produces significant bending moment of stress force upon the housing 21 and its related components, causing eventual fatigue breakage. In the present invention, the stop impact takes place closely adjacent the fulcrum point "A", thus reducing the distance between fulcrum and impact point to virtually zero and thus eliminating bending moment of stress force for all practical purposes. As a result, the potentially damaging stop impact is reduced to the simple shearing force which is placed on the solvent welded joint at point "A". A shearing force of this nature places little stress on the housing and can readily be handled.

2. Similarly the inertia of upward movement of the metal weight 30 is transferred to the nozzle shell 25 at a point directly adjacent the point where the shell is attached to the nozzle stem 33, and again the potential for bending stress has been eliminated.

3. The elimination of bending moment of stress force permits the housing and related components to be constructed of lighter weight materials, thus improving the economics of the installation, as well as the ease of assembly.

4. The retainer 39 is constructed in such manner as to bleed off water pressure from leaking sequencing valves and thus eliminates unwanted spinning of the nozzle when the nozzle is supposed to be at rest. As best shown in FIG. 4, water pressure from leaking valves can cause flow of water (albeit reduced) from inlet pipe 23 into the bottom of hollow nozzle stem 33, even though the nozzle is supposed to be deenergized. Although the leakage water pressure is not strong enough to pop the nozzle up to its extended operative position, there is sufficient pressure in past versions to cause the nozzle to rotate slowly in place, which detracts from the appearance of efficiency of the system. In the present invention, this is avoided because a sufficient flow of leakage water is diverted into the passageway 40A between the outer surface of the nozzle stem 33 and the inner surface of the bore 40 in retainer 39. The leakage water flows upwardly through this channel and eventually bleeds into the pool through the space created by the spacer lugs 32 in the bottom of the nozzle shell, through the openings 47 in the retainer 39 and finally upwardly and out into the pool through the openings 46 in the rim 45 of retainer 39. The bleeding of water pressure in this manner is sufficient to eliminate spinning of the nozzle which might otherwise be caused by flow of water through the interior of the hollow nozzle stem 33.

5. The use of the retainer ensures that all wear damage between the moving parts is caused on parts which are removable, rather than permanent. Thus, the wear and tear resulting from movement of the nozzle assembly within the retainer is limited to these parts only, both of which are removable and replaceable parts.

6. The use of the retainer, together with the locking-/unlocking tool disclosed, provides a positive means for engaging and securing the tool to the assembly to be twisted in or out of locked position. In prior arrangement, particularly with tools attached to long poles for operating when the pool is filled with water, the attempt was to match lugs on the tool with recessions on the nozzle. However, it is difficult to maintain the lugs of such a tool in simple recessions while attempting to twist the nozzle assembly out of the housing. The need is for an undercut recession in the surface of the nozzle, for accepting and positively retaining the matching hooks. However, undercut recessions cannot be formed in plastic nozzle parts by normal injection molding procedures. The special design of the retainer flange 45 of the present invention provides a formed-in-place undercut recession to accept and maintain engagement with the hooks 51 of the locking/unlocking tool.

7. The distribution of the heavy metal weights 30 toward the outside perimeter of the upper nozzle body shell 25 has been found to contribute a stabilizing effect to the rotational movement of the nozzle. It allows the system to take advantage of the full force of the water flow to produce rotation, but at the same time the buffering effect of the heavy metal weights at the outside perimeter of the nozzle tends to stabilize against otherwise erratic rotational movement caused by variables in the system such as valve closure speeds, water pressure variations, and the like.

8. The system is adapted to the use of a simple plaster cap 38 which provides an elegant joint between housing and pool plaster, without bumps, crevices or other imperfections which tended to create difficulties for plasterers in past systems.

9. The availability of two different sized jet outlet holes 27 and 28 in the upper nozzle body allows the assembler to use a single nozzle unit for either one or the other size holes. This improves the inventory storage situation, since only a single kind of nozzle is required to be carried in stock, rather than one for each size of jet reaction opening.

Although preferred embodiments of the invention have been described herein in detail, it will be understood by those skilled in the art that variations may be made thereto without departing from the spirit of the invention.

What is claimed is:

1. A water delivery assembly for cleaning the inner surfaces of a swimming pool, said assembly comprising:

inlet pipe means for introducing water under pressure into said pool, a housing in fluid communication with said inlet pipe means, said housing having an outer open end communicating with the interior of said swimming pool and an inner open end fixedly attached to said inlet pipe;

a water delivery head retainer removably locked to the interior of said housing;

a water delivery head comprising a nozzle and a stem portion attached thereto, said nozzle having at least one water aperture therein to project a pressurized stream of water in adjacent parallel and scrubbing relation to the inner surface of said pool, said delivery head being mounted in said retainer and adapted for reciprocal motion therewithin to an extended operative position and a retracted inoperative position;

said water delivery head responsive to the application of pressurized water to said housing for extending to said extended operative position; said head also responsive to the removal of pressure from the water in said housing for retraction to said retracted inoperative position;

annular shoulder means located at the lower end of the stem portion of said delivery head;

and stop means located on the interior of said housing, cooperating with said annular shoulder means to provide the upper limit of extension of said delivery head; said stop means being located in the bottom part of said housing and adjacent the point where the housing is attached to said inlet pipe, whereby the stop impact caused at said point produces minimum bending moment of stress force on said housing.

2. The water delivery assembly of claim 1 wherein the locking means for said retainer is of the bayonet type.

3. The water delivery assembly of claim 1 wherein the lower edge of said retainer serves as the stop.

4. The water delivery assembly of claim 1 wherein an annular passageway is provided between the outer wall of said retainer and the inner wall of said housing, said passageway being in communication with the interior of said pool; the wall of said retainer has at least one opening permitting communication between the interior of said retainer and said annular passageway; and spacer means are located between said nozzle and the inner wall of said retainer; whereby the flow of leakage water bypasses the said delivery head and is directed into the pool without causing rotation of the head when in its retracted position.

5. The water delivery assembly of claim 4 wherein the said spacer means are lugs on a horizontal bottom surface of said nozzle, said lugs resting on an interior horizontal surface of said retainer.

6. The water delivery assembly of claim 1 wherein the said nozzle is in the form of a disk having the predominant portion of its weight located adjacent its outside perimeter.

7. The water delivery assembly of claim 1 wherein said nozzle includes an internal heavy metal weight bearing against an internal ledge of said nozzle, at a point adjacent the point where the nozzle is attached to said nozzle stem, whereby the transfer of inertial moment from said metal weight to said nozzle produces minimum bending moment stress.

8. The water delivery assembly of claim 1 wherein the said nozzle contains multiple water-ejection apertures of differing sizes and said hollow stem is formed for mounting in said nozzle to register with a selected one of said apertures.

9. A water delivery assembly for cleaning the inner surfaces of a swimming pool, said assembly comprising:

inlet pipe means for introducing water under pressure into said pool, a housing in fluid communication with said inlet pipe means, said housing having an outer open end communicating with the interior of said swimming pool and an inner open end fixedly attached to said inlet pipe below the surface of said pool;

a water delivery retainer removably locked to the interior of said housing;

a rotatable water delivery head comprising a nozzle and a stem portion, said nozzle having at least one water aperture therein to project a pressurized stream of water in adjacent parallel and scrubbing relation to the inner surface of said pool, said delivery head being mounted in said retainer and adapted for reciprocal motion therewithin to an extended operative position and a retracted inoperative position, said delivery head also adapted for limited random rotation only when positioned between said extended operative position and said retracted inoperative position; said water delivery head responsive to the application of pressurized water to said housing for extending to said extended operative position; said head also responsive to the removal of pressure from the water in said housing for retraction to said retracted inoperative position;

means responsive to the application of pressurized water to said housing for rotating said delivery head a random angular distance during movement between its retracted inoperative position and extended operative position;

annular shoulder means located at the lower end of the stem portion of said delivery head;

and stop means located on the interior of said housing, cooperating with said annular shoulder means to provide the upper limit of extension of said delivery head; said stop means being located adjacent the point where the housing is attached to said inlet pipe, whereby the stop impact at said point produces minimum bending moment of stress force on said housing.

10. The water delivery assembly of claim 9 wherein said means for causing said delivery head to rotate includes the stream of water projected from said delivery head, said stream of water directed from said delivery head from a position offset with respect to an axis of rotation of said head to cause a jet reaction urging said head to rotate about said axis.

11. The water delivery assembly of claim 9 wherein said retainer includes an upper flange having gaps which form undercut recesses for accepting and retaining matching hooks of an associated removal tool.

12. The water delivery assembly of claim 11 wherein said retainer includes retention means for maintaining said removal tool in engaged position until the unlocked retainer/nozzle assembly is removed from the housing and the pool.

13. The water delivery assembly of claim 12 wherein said retention means comprises a friction nub on said retainer for engagement with said tool.

* * * * *